US010167691B2

(12) United States Patent
Zhang et al.

(10) Patent No.: US 10,167,691 B2
(45) Date of Patent: Jan. 1, 2019

(54) DOWNHOLE TOOLS HAVING CONTROLLED DISINTEGRATION

(71) Applicants: Zhihui Zhang, Katy, TX (US); Zhiyue Xu, Cypress, TX (US); Goang-Ding Shyu, Houston, TX (US); Juan Carlos Flores Perez, The Woodlands, TX (US)

(72) Inventors: Zhihui Zhang, Katy, TX (US); Zhiyue Xu, Cypress, TX (US); Goang-Ding Shyu, Houston, TX (US); Juan Carlos Flores Perez, The Woodlands, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/472,382

(22) Filed: Mar. 29, 2017

(65) Prior Publication Data

US 2018/0283119 A1 Oct. 4, 2018

(51) Int. Cl.

| | |
|---|---|
| ***E21B 29/02*** | (2006.01) |
| ***E21B 29/00*** | (2006.01) |
| ***E21B 34/16*** | (2006.01) |

(52) U.S. Cl.

CPC ..... *E21B 29/02* (2013.01); *E21B 29/00* (2013.01); *E21B 34/16* (2013.01)

(58) Field of Classification Search

CPC ..... E21B 29/00; E21B 29/02; E21B 34/16

See application file for complete search history.

(56) References Cited

U.S. PATENT DOCUMENTS

| | | | |
|---|---|---|---|
| 6,253,843 | B1 | 7/2001 | Rawson et al. |
| 7,270,191 | B2 | 9/2007 | Drummond et al. |
| 8,056,638 | B2 | 11/2011 | Clayton et al. |
| 8,235,102 | B1 | 8/2012 | Robertson |
| 8,256,521 | B2 | 9/2012 | Swor et al. |
| 8,272,446 | B2 | 9/2012 | Swor et al. |
| 8,291,969 | B2 | 10/2012 | Swor et al. |
| 8,291,970 | B2 | 10/2012 | Swor et al. |

(Continued)

FOREIGN PATENT DOCUMENTS

WO 2013022635 A2 2/2013

OTHER PUBLICATIONS

International Search Report, International Application No. PCT/US2017/062285, dated Mar. 5, 2018, Korean Intellectual Property Office; International Search Report 7 pages.

(Continued)

*Primary Examiner* — Giovanna C. Wright
*Assistant Examiner* — Tara E Schimpf
(74) *Attorney, Agent, or Firm* — Cantor Colburn LLP

(57) ABSTRACT

A multilayered unit includes a core comprising an energetic material and an activator; a support layer disposed on the core; and a protective layer disposed on the support layer, wherein the support layer and the protective layer each independently comprises a polymeric material, a metallic material, or a combination comprising at least one of the foregoing, provided that the support layer is compositionally different from the protective layer. The multilayered unit can be embedded in a component, attached to a component, or disposed between two components of a downhole assembly. The downhole assembly containing the multilayered unit has controlled disintegration in a downhole environment.

24 Claims, 3 Drawing Sheets

(56) References Cited

U.S. PATENT DOCUMENTS

| | | | | |
|---|---|---|---|---|
| 8,322,449 | B2 | 12/2012 | Clayton et al. | |
| 8,327,926 | B2 | 12/2012 | Robertson | |
| 8,403,037 | B2 | 3/2013 | Agrawal et al. | |
| 8,528,633 | B2 | 9/2013 | Agrawal et al. | |
| 9,022,107 | B2 | 5/2015 | Agrawal et al. | |
| 9,101,978 | B2 | 8/2015 | Xu et al. | |
| 9,267,347 | B2 | 2/2016 | Agrawal et al. | |
| 2007/0209802 | A1 | 9/2007 | Xu et al. | |
| 2013/0160992 | A1* | 6/2013 | Agrawal | E21B 23/04 166/193 |
| 2014/0014339 | A1 | 1/2014 | O'Malley et al. | |
| 2014/0190685 | A1 | 7/2014 | Frazier et al. | |
| 2014/0202712 | A1 | 7/2014 | Fripp et al. | |
| 2014/0251612 | A1 | 9/2014 | Powers | |
| 2014/0262327 | A1 | 9/2014 | Xu et al. | |
| 2014/0363692 | A1 | 12/2014 | Marya et al. | |
| 2015/0027723 | A1 | 1/2015 | Fripp et al. | |
| 2015/0190984 | A1 | 7/2015 | Zhang et al. | |
| 2015/0239795 | A1* | 8/2015 | Doud | C06B 45/32 428/649 |
| 2015/0259263 | A1 | 9/2015 | Sherman et al. | |
| 2015/0292288 | A1 | 10/2015 | Kasperski et al. | |
| 2016/0130906 | A1 | 5/2016 | Garvey et al. | |
| 2016/0209391 | A1 | 7/2016 | Zhang et al. | |
| 2016/0333668 | A1 | 11/2016 | Xu et al. | |
| 2017/0009563 | A1 | 1/2017 | Holder | |
| 2018/0171736 | A1 | 6/2018 | Xu et al. | |
| 2018/0171737 | A1 | 6/2018 | Xu et al. | |
| 2018/0171738 | A1 | 6/2018 | Xu et al. | |
| 2018/0171757 | A1 | 6/2018 | Xu | |

OTHER PUBLICATIONS

International Written Opinion, International Application No. PCT/US2017/062285, dated Mar. 5, 2018, Korean Intellectual Property Office; International Written Opinion 11 pages.

* cited by examiner

DOWNHOLE TOOLS HAVING CONTROLLED DISINTEGRATION

BACKGROUND

Oil and natural gas wells often utilize wellbore components or tools that, due to their function, are only required to have limited service lives that are considerably less than the service life of the well. After a component or tool service function is complete, it must be removed or disposed of in order to recover the original size of the fluid pathway for use, including hydrocarbon production, $CO_2$ sequestration, etc. Disposal of components or tools has conventionally been done by milling or drilling the component or tool out of the wellbore, which are generally time consuming and expensive operations.

Recently, self-disintegrating downhole tools have been developed. Instead of milling or drilling operations, these tools can be removed by dissolution of engineering materials using various wellbore fluids. One challenge for the self-disintegrating downhole tools is that the disintegration process can start as soon as the conditions in the well allow the corrosion reaction of the engineering material to start. Thus the disintegration period is not controllable as it is desired by the users but rather ruled by the well conditions and product properties. For certain applications, the uncertainty associated with the disintegration period can cause difficulties in well operations and planning. An uncontrolled disintegration can also delay well productions. Therefore, the development of downhole tools that can be disintegrated on-demand is very desirable.

BRIEF DESCRIPTION

A downhole article comprises a matrix; and a multilayered unit disposed in the matrix, the multilayered unit including: a core comprising an energetic material and an activator; a support layer disposed on the core; and a protective layer disposed on the support layer, wherein the support layer and the protective layer each independently comprises a polymeric material, a metallic material, or a combination comprising at least one of the foregoing, provided that the support layer is compositionally different from the protective layer.

A downhole assembly comprises a first component and a multilayered unit disposed on a surface of the first component, the multilayered unit including: a core comprising an energetic material and an activator; a support layer disposed on the core; and a protective layer disposed on the support layer, wherein the support layer and the protective layer each independently comprises a polymeric material, a metallic material, or a combination comprising at least one of the foregoing, provided that that support layer is compositionally different from the protective layer.

A method of controllably removing the above downhole article or downhole assembly comprises disposing the downhole article or downhole assembly in a downhole environment; performing a downhole operation; activating the energetic material; and disintegrating the downhole article or downhole assembly.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
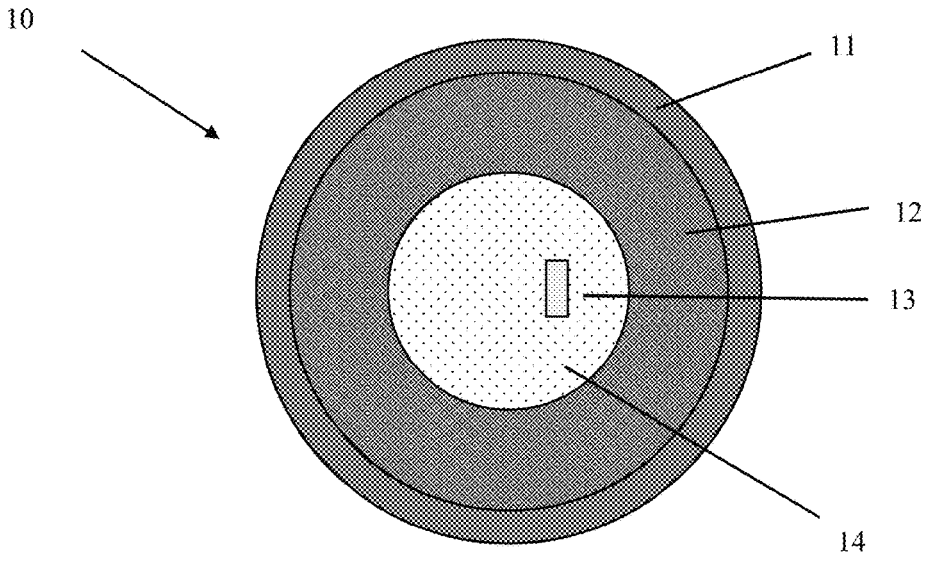
FIG. 1 is a cross-sectional view of an exemplary multilayered unit according to an embodiment of the disclosure.

The disclosure provides a multilayered unit that can be embedded in a downhole article, attached to a downhole article, or disposed between two adjacent components of a downhole assembly. The downhole article or downhole assembly containing the multilayered unit has controlled disintegration in a downhole environment. The controlled disintegration is implemented through integrating a high-strength matrix material with energetic material that can be triggered on demand for rapid tool disintegration.

The multilayered unit includes a core comprising an energetic material and an activator; a support layer disposed on the core; and a protective layer disposed on the support layer, wherein the support layer and the protective layer each independently comprises a polymeric material, a metallic material, or a combination comprising at least one of the foregoing, provided that the support layer is compositionally different from the protective layer.

The multilayered unit can have various shapes and dimensions. In an embodiment, the multilayered unit has at least one stress concentration location to promote disintegration. As used herein, a stress concentration location refers to a location in an object where stress is concentrated. Examples of stress concentration locations include but are not limited to sharp corners, notches, or grooves. The multilayered unit can have a spherical shape or an angular shape such as a triangle, rhombus, pentagon, hexagon, or the like. The multilayered unit can also be a rod or sheet. The matrix around the multilayered unit can also have stress concentration locations.

The energetic material comprises a thermite, a thermate, a solid propellant fuel, or a combination comprising at least one of the foregoing. The thermite materials include a metal powder (a reducing agent) and a metal oxide (an oxidizing agent), where choices for a reducing agent include aluminum, magnesium, calcium, titanium, zinc, silicon, boron, and combinations including at least one of the foregoing, for example, while choices for an oxidizing agent include boron oxide, silicon oxide, chromium oxide, manganese oxide, iron oxide, copper oxide, lead oxide and combinations including at least one of the foregoing, for example.

Thermate materials comprise a metal powder and a salt oxidizer including nitrate, chromate and perchlorate. For example thermite materials include a combination of barium chromate and zirconium powder; a combination of potassium perchlorate and metal iron powder; a combination of titanium hydride and potassium perchlorate, a combination of zirconium hydride and potassium perchlorate, a combination of boron, titanium powder, and barium chromate, or a combination of barium chromate, potassium perchlorate, and tungsten powder.

Solid propellant fuels may be generated from the thermate compositions by adding a binder that meanwhile serves as a secondary fuel. The thermate compositions for solid propellants include, but not limited to, perchlorate and nitrate, such as ammonium perchlorate, ammonium nitrate, and potassium nitrate. The binder material is added to form a thickened liquid and then cast into various shapes. The binder materials include polybutadiene acrylonitrile (PBAN), hydroxyl-terminated polybutadiene (HTPB), or polyurethane. An exemplary solid propellant fuel includes ammonium perchlorate ($NH_4ClO_4$) grains (20 to 200 μm) embedded in a rubber matrix that contains 69-70% finely ground ammonium perchlorate (an oxidizer), combined with 16-20% fine aluminum powder (a fuel), held together in a base of 11-14% polybutadiene acrylonitrile or hydroxyl-terminated polybutadiene (polybutadiene rubber matrix). Another example of the solid propellant fuels includes zinc metal and sulfur powder.

As used herein, the activator is a device that is effective to generate spark, electrical current, or a combination thereof to active the energetic material. The activator can be triggered by a preset timer, characteristic acoustic waves generated by perforations from following stages, a pressure signal from fracking fluid, or an electrochemical signal interacting with the wellbore fluid. Other known methods to activating an energetic material can also be used.

The multilayered unit has a support layer to hold the energetic materials together. The Support layer can also provide structural integrity to the multilayered unit.

The multilayered unit has a protective layer so that the multilayered unit does not disintegrate prematurely during the material fabrication process. In an embodiment, the protective layer has a lower corrosion rate than the support layer when tested under the same testing conditions. The support layer and the protective layer each independently includes a polymeric material, a metallic material, or a combination comprising at least one of the foregoing. The polymeric material and the metallic material can corrode once exposed to a downhole fluid, which can be water, brine, acid, or a combination comprising at least one of the foregoing. In an embodiment, the downhole fluid includes potassium chloride (KCl), hydrochloric acid (HCl), calcium chloride ($CaCl_2$), calcium bromide ($CaBr_2$) or zinc bromide ($ZnBr_2$), or a combination comprising at least one of the foregoing.

In an embodiment, the support layer comprises the metallic material, and the protective layer comprises the polymeric material. In another embodiment, the support layer comprises the polymeric material, and the protective layer comprises the metallic material. In yet another embodiment, both the support layer and the protective layer comprise a polymeric material. In still another embodiment, both the support layer and the protective layer comprise a metallic material.

Exemplary polymeric materials include a polyethylene glycol, a polypropylene glycol, a polyglycolic acid, a polycaprolactone, a polydioxanone, a polyhydroxyalkanoate, a polyhydroxybutyrate, a copolymer thereof, or a combination comprising at least one of the foregoing.

The metallic material can be a corrodible metallic material, which includes a metal, a metal composite, or a combination comprising at least one of the foregoing. As used herein, a metal includes metal alloys.

Exemplary corrodible metallic materials include zinc metal, magnesium metal, aluminum metal, manganese metal, an alloy thereof, or a combination comprising at least one of the foregoing. In addition to zinc, magnesium, aluminum, manganese, or alloys thereof, the corrodible material can further comprise a cathodic agent such as Ni, W, Mo, Cu, Fe, Cr, Co, an alloy thereof, or a combination comprising at least one of the foregoing to adjust the corrosion rate of the corrodible material. The corrodible material (anode) and the cathodic agent are constructed on the microstructural level to form μm-scale galvanic cells (micro-galvanic cells) when the material are exposed to an electrolytic fluid such as downhole brines. The cathodic agent has a standard reduction potential higher than −0.6 V. The net cell potential between the corrodible material and cathodic agent is above 0.5 V, specifically above 1.0 V.

Magnesium alloy is specifically mentioned. Magnesium alloys suitable for use include alloys of magnesium with aluminum (Al), cadmium (Cd), calcium (Ca), cobalt (Co), copper (Cu), iron (Fe), manganese (Mn), nickel (Ni), silicon (Si), silver (Ag), strontium (Sr), thorium (Th), tungsten (W), zinc (Zn), zirconium (Zr), or a combination comprising at least one of these elements. Particularly useful alloys include magnesium alloyed with Ni, W, Co, Cu, Fe, or other metals. Alloying or trace elements can be included in varying amounts to adjust the corrosion rate of the magnesium. For example, four of these elements (cadmium, calcium, silver, and zinc) have to mild-to-moderate accelerating effects on corrosion rates, whereas four others (copper, cobalt, iron, and nickel) have a still greater effect on corrosion. Exemplary commercial magnesium alloys which include different combinations of the above alloying elements to achieve different degrees of corrosion resistance include but are not limited to, for example, those alloyed with aluminum, strontium, and manganese such as AJ62, AJ50x, AJ51x, and AJ52x alloys, and those alloyed with aluminum, zinc, and manganese such as AZ91A-E alloys.

As used herein, a metal composite refers to a composite having a substantially-continuous, cellular nanomatrix comprising a nanomatrix material; a plurality of dispersed particles comprising a particle core material that comprises Mg, Al, Zn or Mn, or a combination thereof, dispersed in the cellular nanomatrix; and a solid-state bond layer extending throughout the cellular nanomatrix between the dispersed particles. The matrix comprises deformed powder particles formed by compacting powder particles comprising a particle core and at least one coating layer, the coating layers joined by solid-state bonding to form the substantially-continuous, cellular nanomatrix and leave the particle cores as the dispersed particles. The dispersed particles have an average particle size of about 5 μm to about 300 μm. The nanomatrix material comprises Al, Zn, Mn, Mg, Mo, W, Cu, Fe, Si, Ca, Co, Ta, Re or Ni, or an oxide, carbide or nitride thereof, or a combination of any of the aforementioned materials. The chemical composition of the nanomatrix material is different than the chemical composition of the particle core material.

The corrodible metallic material can be formed from coated particles such as powders of Zn, Mg, Al, Mn, an alloy thereof, or a combination comprising at least one of the foregoing. The powder generally has a particle size of from about 50 to about 150 micrometers, and more specifically about 5 to about 300 micrometers, or about 60 to about 140 micrometers. The powder can be coated using a method such as chemical vapor deposition, anodization or the like, or admixed by physical method such cryo-milling, ball milling, or the like, with a metal or metal oxide such as Al, Ni, W, Co, Cu, Fe, oxides of one of these metals, or the like. The coating layer can have a thickness of about 25 nm to about 2,500 nm. Al/Ni and Al/W are specific examples for the coating layers. More than one coating layer may be present. Additional coating layers can include Al, Zn, Mg, Mo, W, Cu, Fe, Si, Ca, Co, Ta, or Re. Such coated magnesium powders are referred to herein as controlled electrolytic materials (CEM). The CEM materials are then molded or compressed forming the matrix by, for example, cold compression using an isostatic press at about 40 to about 80 ksi (about 275 to about 550 MPa), followed by forging or sintering and machining, to provide a desired shape and dimensions of the disintegrable article. The CEM materials including the composites formed therefrom have been described in U.S. Pat. Nos. 8,528,633 and 9,101,978.

In an embodiment, the metallic material comprises Al, Mg, Zn. Mn, Fe, an alloy thereof, or a combination comprising at least one of the foregoing. In specific embodiments, the metallic material comprises aluminum alloy, magnesium alloy, zinc alloy, iron alloy, or a combination comprising at least one of the foregoing. In the instance wherein both the support layer and the protective layer comprise a metallic material, the metallic materials in the support layer and the protective layer are selected such that the support layer and the protective layer are easier to disintegrate when the energetic material is activated as compared to an otherwise identical unit except for containing only one metallic layer.

The core is present in an amount of about 5 to about 80 vol %, specifically about 15 to about 70 vol %; the support layer is present in an amount of about 20 to about 95 vol %, specifically about 30 to about 85; and the protective layer is present in an amount of about 0.1 to about 20 vol %, specifically about 1 to about 10 vol %, each based on the total volume of the multilayered unit.

FIG. 1 is a cross-sectional view of an exemplary multilayered unit according to an embodiment of the disclosure. As shown in FIG. 1, multilayered unit 10 has a core 14, an activator 13 disposed in the core, a support layer 12 disposed on the core, and a protective layer 11 disposed on the support layer.

The multilayered units can be embedded into different tools. The location and number of MLM units are selected to ensure that the whole tool can disintegrate into multiple pieces when the energetic material is activated. Thus in an embodiment, the disclosure provides a disintegrable article comprising a matrix and a multilayered unit embedded therein. The matrix of the article can be formed from a corrodible metallic material as described herein. The matrix can further comprise additives such as carbides, nitrides, oxides, precipitates, dispersoids, glasses, carbons, or the like in order to control the mechanical strength and density of the articles if needed. In an embodiment, the matrix has pre-cracks including but not limited to pre-crack notches or pre-crack grooves around the multilayered unit to facilitate the quick disintegration of the article once the energetic material is activated.

Figure 2:
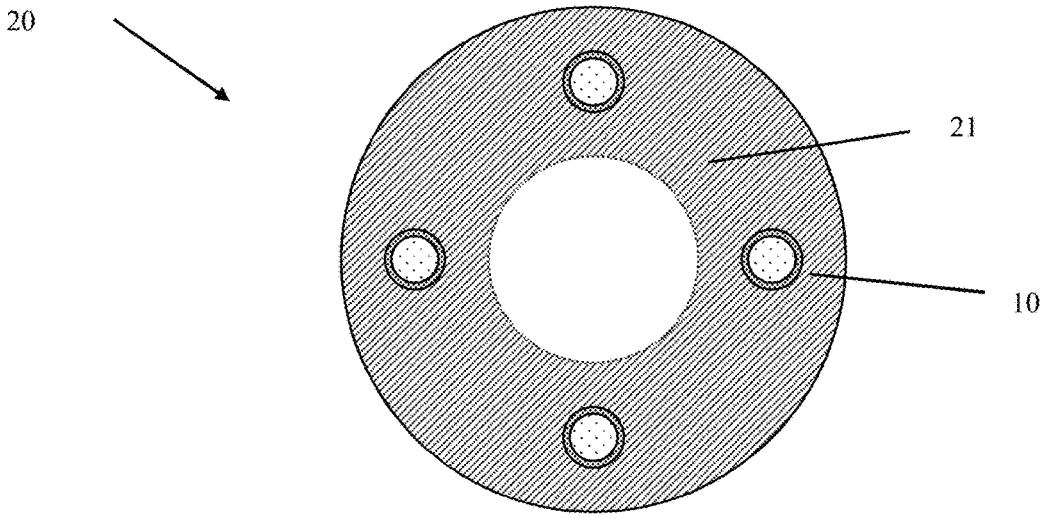
FIG. 2 is a cross-sectional view of an exemplary downhole article embedded with multilayered units.
Figure 3:
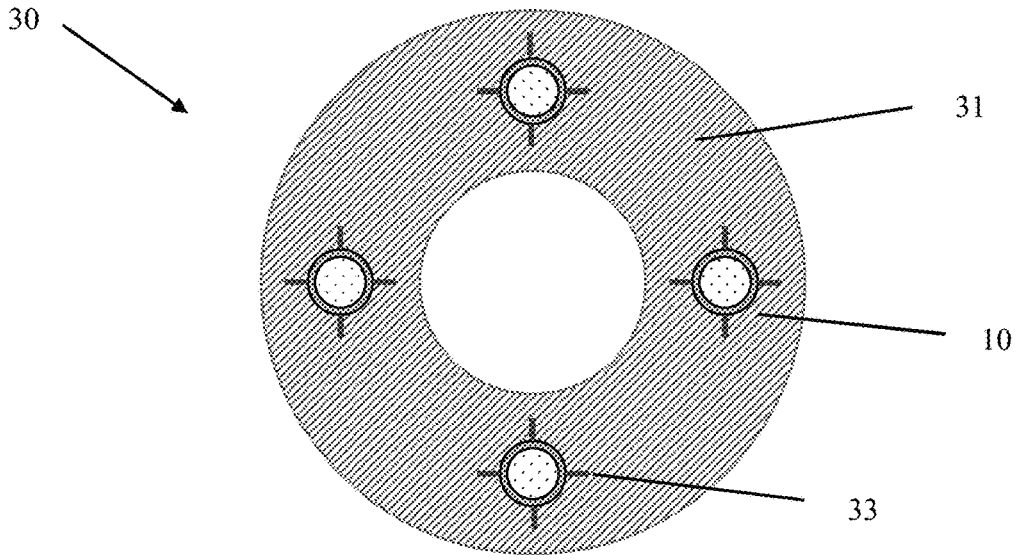
FIG. 3 is a cross-sectional view of another exemplary downhole article embedded with multilayered units, wherein the downhole article has pre-cracks around the multilayered units.
Figure 4:
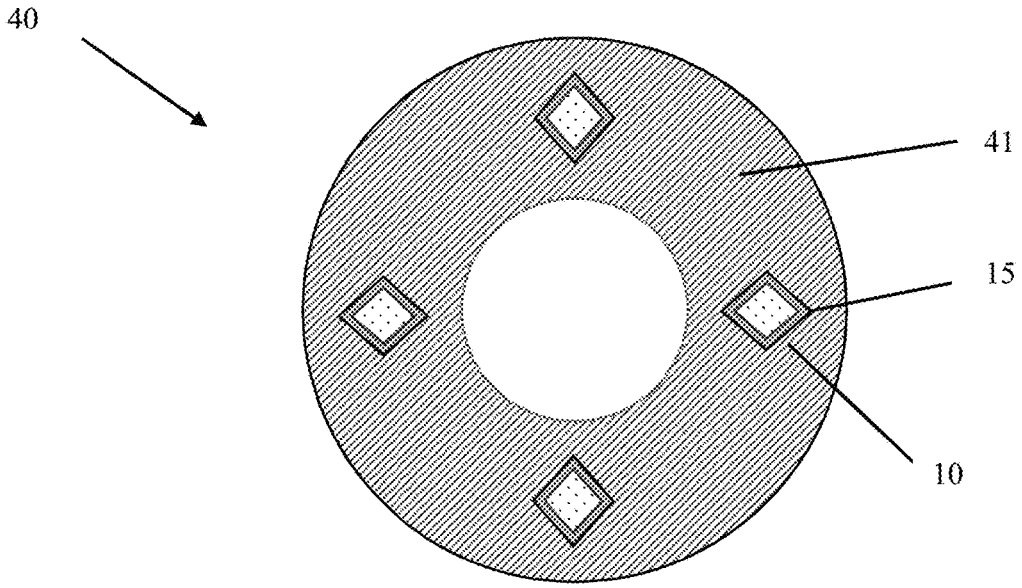
FIG. 4 is a cross-sectional view of yet another exemplary downhole article embedded with multilayered units, wherein the multilayered units and the matrix of the downhole article surrounding the multilayered units have stress concentration locations.
Figure 5:
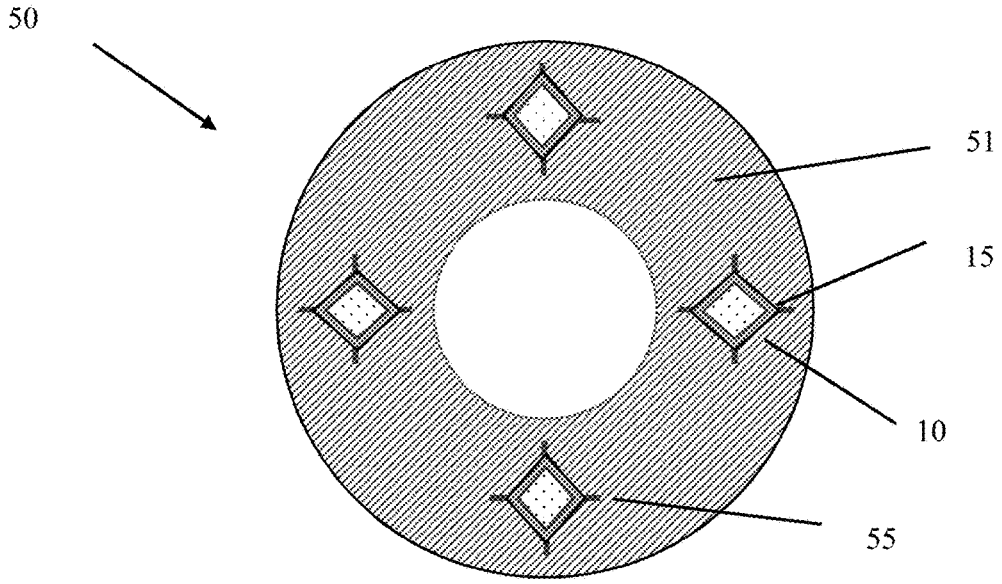
FIG. 5 is a cross-sectional view of still another exemplary downhole article embedded with multilayered units, wherein the multilayered units have stress concentration locations; and the downhole article matrix surrounding the multilayered unit has stress concentration locations as well as pre-cracks.

FIGS. 2-4 are cross-sectional views of various exemplary downhole articles embedded with multilayered units. In downhole article 20, multiple multilayered units 10 as described herein are embedded in matrix 21. In downhole article 30, multilayered units 10 are disposed in matrix 31, wherein matrix 31 has pre-cracks 33. In downhole article 40, multilayered units 10 are embedded in matrix 41, where the multilayered units have stress concentration locations 15. In downhole article 50, the multilayered units have stress concentration locations 15 and the matrix 51 has pre-cracks 55.

Disintegrable articles are not particularly limited. Exemplary articles include a ball, a ball seat, a fracture plug, a bridge plug, a wiper plug, shear out plugs, a debris barrier, an atmospheric chamber disc, a swabbing element protector, a sealbore protector, a screen protector, a beaded screen protector, a screen basepipe plug, a drill in stim liner plug, ICD plugs, a flapper valve, a gaslift valve, a transmatic CEM plug, float shoes, darts, diverter balls, shifting/setting balls, ball seats, sleeves, teleperf disks, direct connect disks, drill-in liner disks, fluid loss control flappers, shear pins or screws, cementing plugs, teleperf plugs, drill in sand control beaded screen plugs, HP beaded frac screen plugs, hold down dogs and springs, a seal bore protector, a stimcoat screen protector, or a liner port plug. In specific embodiments, the disintegrable article is a ball, a fracture plug, or a bridge plug.

A downhole assembly comprising a downhole article having a multilayered unit embedded therein is also provided. More than one component of the downhole article can be an article having embedded multilayered units.

The multilayered units can also be disposed on a surface of an article. In an embodiment, a downhole assembly comprises a first component and a multilayered unit disposed on a surface of the first component. The downhole assembly further comprises a second component, and the multilayer unit is disposed between the first and second components. The first component, the second component, or both can comprise corrodible metallic material as disclosed herein. Exemplary downhole assemblies include frac plugs, bridge plugs, and the like.

Figure 6:
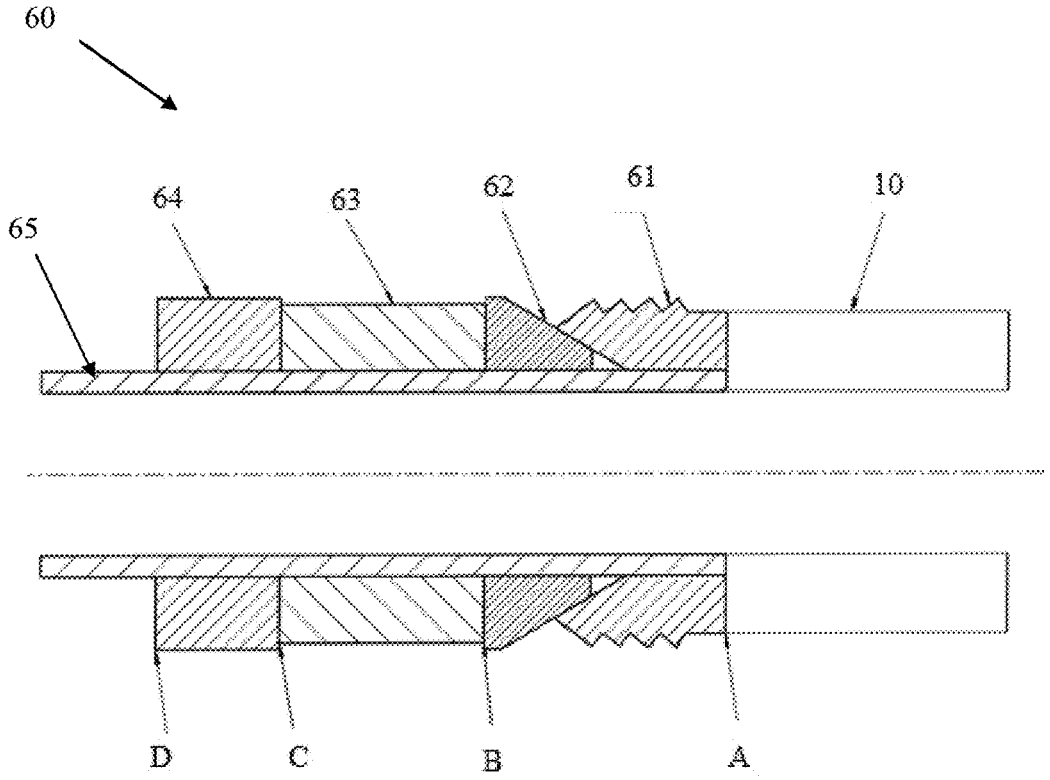
FIG. 6 illustrates a downhole assembly having a multilayered unit attached to a component of the assembly or disposed between adjacent components of the assembly.

FIG. 6 illustrates a downhole assembly having a multilayered unit attached to a component of the assembly or disposed between adjacent components of the assembly. As shown in FIG. 6, downhole assembly 60 includes an annular body 65 having a flow passage therethrough; a frustoconical element 62 disposed about the annular body 65; a sealing element 63 carried on the annular body 65 and configured to engage a portion of the frustoconical element 63; and a slip segment 61 and an abutment element 64 disposed about the annular body 65. One or more of the frustoconical element 62, sealing element 63, abutment element 64, and slip segment 61 can have embedded multilayered units 10 as disclosed herein. Alternatively or in addition, a multilayered unit 10 can be disposed on a surface of the slip segment 61 (position A), disposed on a surface of abutment element 64 (position D), between frustoconical element 62 and sealing element 63 (position B) or between sealing member 63 and abutment element 64 (position C).

A method of controllably removing a downhole article or a downhole assembly comprises disposing a downhole article or a downhole assembly as described herein in a downhole environment; performing a downhole operation; activating the energetic material; and disintegrating the downhole article. A downhole operation can be any operation that is performed during drilling, stimulation, completion, production, or remediation. A fracturing operation is specifically mentioned. To start an on-demand disintegration process, one multilayered unit is triggered and other units will continue the rapid disintegration process following a series of sequenced reactions. The sequenced reactions might be triggered by pre-set timers in different units. Alternatively, the energetic material in one unit is activated and reacts to generate heat, strain, vibration, an acoustic signal or the like, which can be sensed by an adjacent unit and activate the energetic material in the adjacent unit. The energetic material in the adjacent unit reacts and generates a signal that leads to the activation of the energetic material in an additional unit. The process repeats and sequenced reactions occur.

Disintegrating the downhole article comprises breaking the downhole article into a plurality of discrete pieces. Advantageously, the discrete pieces can further corrode in the downhole fluid and eventually completely dissolve in the downhole fluid or become smaller pieces which can be carried back to the surface by wellbore fluids.

Set forth below are various embodiments of the disclosure.

Embodiment 1

A downhole article comprising: a matrix; and a multilayered unit disposed in the matrix, the multilayered unit including: a core comprising an energetic material and an activator; a support layer disposed on the core; and a protective layer disposed on the support layer, wherein the support layer and the protective layer each independently comprises a polymeric material, a metallic material, or a combination comprising at least one of the foregoing, provided that the support layer is compositionally different from the protective layer.

Embodiment 2

The downhole article of Embodiment 1, wherein the multilayered unit has at least one stress concentration location.

Embodiment 3

The downhole article of Embodiment 1 or Embodiment 2, the matrix has a pre-crack around the multilayered unit.

Embodiment 4

The downhole article of any one of Embodiments 1 to 3, wherein the activator is a device that is effective to generate spark, electrical current, or a combination thereof to active the energetic material.

Embodiment 5

The downhole article of any one of Embodiments 1 to 4, wherein the energetic material comprises a thermite, a thermate, a solid propellant fuel, or a combination comprising at least one of the foregoing.

Embodiment 6

The downhole article of any one of Embodiments 1 to 5, wherein the metallic material comprises Zn, Mg, Al, Mn, iron, an alloy thereof, or a combination comprising at least one of the foregoing.

Embodiment 7

The downhole article of any one of Embodiments 1 to 6, wherein the polymeric material comprises a polyethylene glycol, a polypropylene glycol, a polyglycolic acid, a polycaprolactone, a polydioxanone, a polyhydroxyalkanoate, a polyhydroxybutyrate, a copolymer thereof, or a combination comprising at least one of the foregoing.

Embodiment 8

The downhole article of any one of Embodiments 1 to 7, wherein the support layer comprises the metallic material; and the protective layer comprises the polymeric material.

Embodiment 9

The downhole article of any one of Embodiments 1 to 7, wherein the support layer comprises the polymeric material; and the protective layer comprises the metallic material.

Embodiment 10

The downhole article of any one of Embodiments 1 to 9, wherein the core is present in an amount of 5 to 80 vol %, the support layer is present in an amount of 20 to 95 vol %, and the protective layer is present in an amount of 0.1 to 20 vol %, each based on the total volume of the multilayered unit.

Embodiment 11

A downhole assembly comprising a downhole article of any one of Embodiments 1 to 10.

Embodiment 12

A downhole assembly comprising a first component and a multilayered unit disposed on a surface of the first component, the multilayered unit including: a core comprising an energetic material and an activator; a support layer disposed on the core; and a protective layer disposed on the support layer, wherein the support layer and the protective layer each independently comprises a polymeric material, a metallic material, or a combination comprising at least one of the foregoing, provided that the support layer is compositionally different from the protective layer.

Embodiment 13

The downhole assembly of Embodiment 12, wherein the downhole assembly further comprises a second component, and the multilayer unit is disposed between the first and second components.

Embodiment 14

The downhole article of Embodiment 12 or Embodiment 13, wherein the activator is a device that is effective to generate spark, electrical current, or a combination thereof to active the energetic material.

Embodiment 15

The downhole assembly of any one of Embodiments 12 to 14, wherein the first component, the second component, or both comprise Zn, Mg, Al, Mn, an alloy thereof, or a combination comprising at least one of the foregoing.

Embodiment 16

The downhole assembly of any one of Embodiments 12 to 15, wherein the multilayered unit has at least one stress concentration location.

Embodiment 17

The downhole assembly of any one of Embodiments 12 to 16, wherein the polymeric material comprises a polyethylene glycol, a polypropylene glycol, a polyglycolic acid, a polycaprolactone, a polydioxanone, a polyhydroxyalkanoate, a polyhydroxybutyrate, a copolymer thereof, or a combination comprising at least one of the foregoing.

Embodiment 18

A method of controllably removing a downhole article, the method comprising: disposing a downhole article of any one of Embodiments 1 to 10 in a downhole environment; performing a downhole operation; activating the energetic material; and disintegrating the downhole article.

Embodiment 19

The method of Embodiment 18, wherein disintegrating the downhole article comprises breaking the downhole article into a plurality of discrete pieces; and the method further comprises corroding the discrete pieces in a downhole fluid.

Embodiment 20

The method of Embodiment 18 or Embodiment 19, wherein activating the energetic material comprises triggering the activator by a preset timer, a characteristic acoustic wave generated by a perforation from a following stage, a pressure signal from fracking fluid, an electrochemical signal interacting with a wellbore fluid, or a combination comprising at least one of the foregoing.

Embodiment 21

A method of controllably removing a downhole assembly, the method comprising: disposing a downhole assembly of any one of Embodiments 12 to 17 in a downhole environment; performing a downhole operation; activating the energetic material in the multilayered unit; and disintegrating the downhole assembly.

Embodiment 22

The method of Embodiment 21, wherein disintegrating the downhole assembly comprises breaking the downhole assembly into a plurality of discrete pieces; and the method further comprises corroding the discrete pieces in a downhole fluid.

Embodiment 23

The method of Embodiment 21 or Embodiment 22, wherein activating the energetic material comprises triggering the activator by a preset timer, a characteristic acoustic wave generated by a perforation from a following stage, a pressure signal from fracking fluid, an electrochemical signal interacting with a wellbore fluid, or a combination comprising at least one of the foregoing.

All ranges disclosed herein are inclusive of the endpoints, and the endpoints are independently combinable with each other. As used herein, "combination" is inclusive of blends, mixtures, alloys, reaction products, and the like. All references are incorporated herein by reference in their entirety.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." The modifier "about" used in connection with a quantity is inclusive of the stated value and has the meaning dictated by the context (e.g., it includes the degree of error associated with measurement of the particular quantity).

What is claimed is:

1. A downhole article comprising:
a matrix; and
a multilayered unit embedded in the matrix, the multilayered unit including:
a core comprising an energetic material and an activator;
a support layer disposed on the core; and
a protective layer disposed on the support layer,
wherein the support layer comprises a first material and the protective layer comprises a second material, the first material and the second material each independently comprises a polymeric material, a metallic material, or a combination comprising at least one of the foregoing, provided that the first material is different from the second material.

2. The downhole article of claim 1, wherein the multilayered unit has at least one stress concentration location.

3. The downhole article of claim 1, the matrix has a pre-crack around the multilayered unit.

4. The downhole article of claim 1, wherein the activator is a device that is effective to generate spark, electrical current, or a combination thereof to active the energetic material.

5. The downhole article of claim 1, wherein the energetic material comprises a thermite, a thermate, a solid propellant fuel, or a combination comprising at least one of the foregoing.

6. The downhole article of claim 1, wherein at least one of the first and the second materials comprises the metallic material, and the metallic material comprises Zn, Mg, Al, Mn, iron, an alloy thereof, or a combination comprising at least one of the foregoing.

7. The downhole article of claim 1, wherein at least one of the first and second materials comprises the polymeric material, and the polymeric material comprises a polyethylene glycol, a polypropylene glycol, a polyglycolic acid, a polycaprolactone, a polydioxanone, a polyhydroxyalkanoate, a polyhydroxybutyrate, a copolymer thereof, or a combination comprising at least one of the foregoing.

8. The downhole article of claim 1, wherein the support layer comprises the metallic material; and the protective layer comprises the polymeric material.

9. The downhole article of claim 1, wherein the support layer comprises the polymeric material; and the protective layer comprises the metallic material.

10. The downhole article of claim 1, wherein the core is present in an amount of 5 to 80 vol %, the support layer is present in an amount of 20 to 95 vol %, and the protective layer is present in an amount of 0.1 to 20 vol %, each based on the total volume of the multilayered unit.

11. The downhole article of claim 1, wherein the matrix is formed from a corrodible metallic material.

12. The downhole article of claim 11, wherein the downhole article comprises a plurality of the multilayered units embedded in the matrix.

13. A downhole assembly comprising the downhole article of claim 1.

14. A method of controllably removing a downhole article, the method comprising:

disposing the downhole article of claim 1 in a downhole environment;

performing a downhole operation;

activating the energetic material; and disintegrating the downhole article.

15. The method of claim 14, wherein disintegrating the downhole article comprises breaking the downhole article into a plurality of discrete pieces; and the method further comprises corroding the discrete pieces in a downhole fluid.

16. The method of claim 14, wherein activating the energetic material comprises triggering the activator by a preset timer, a characteristic acoustic wave generated by a perforation from a following stage, a pressure signal from fracking fluid, an electrochemical signal interacting with a wellbore fluid, or a combination comprising at least one of the foregoing.

17. A downhole assembly comprising a first component, a second component, and a multilayered unit disposed between the first and second components, the multilayered unit including:

a core comprising an energetic material and an activator;

a support layer disposed on the core; and a protective layer disposed on the support layer, wherein the support layer comprises a first material and the protective layer comprises a second material, each of the first and second materials independently comprises a polymeric material, a metallic material, or a combination comprising at least one of the foregoing, provided that the first material is different from the second material.

18. The downhole article of claim 17, wherein the activator is a device that is effective to generate spark, electrical current, or a combination thereof to active the energetic material.

19. The downhole assembly of claim 17, wherein the first component, the second component, or both comprise Zn, Mg, Al, Mn, an alloy thereof, or a combination comprising at least one of the foregoing.

20. The downhole assembly of claim 17, wherein the multilayered unit has at least one stress concentration location.

21. The downhole assembly of claim 17, wherein at least one of the first and second materials comprises the polymeric material, the polymeric material comprises a polyethylene glycol, a polypropylene glycol, a polyglycolic acid, a polycaprolactone, a polydioxanone, a polyhydroxyalkanoate, a polyhydroxybutyrate, a copolymer thereof, or a combination comprising at least one of the foregoing.

22. A method of controllably removing a downhole assembly, the method comprising:

disposing the downhole assembly of claim 17 in a downhole environment;

performing a downhole operation;

activating the energetic material in the multilayered unit; and disintegrating the downhole assembly.

23. The method of claim 22, wherein disintegrating the downhole assembly comprises breaking the downhole assembly into a plurality of discrete pieces; and the method further comprises corroding the discrete pieces in a downhole fluid.

24. The method of claim 22, wherein activating the energetic material comprises triggering the activator by a preset timer, a characteristic acoustic wave generated by a perforation from a following stage, a pressure signal from fracking fluid, an electrochemical signal interacting with a wellbore fluid, or a combination comprising at least one of the foregoing.

* * * * *